US011648588B2

(12) United States Patent
Johnson

(10) Patent No.: US 11,648,588 B2
(45) Date of Patent: May 16, 2023

(54) CERAMIC LINED APERTURE SCREENING PANEL

(71) Applicant: Polydeck Screen Corporation, Spartanburg, SC (US)

(72) Inventor: Ryan W. Johnson, Moore, SC (US)

(73) Assignee: POLYDECK SCREEN CORPORATION, Spartanburg, SC (US)

( * ) Notice: Subject to any disclaimer, the term of this patent is extended or adjusted under 35 U.S.C. 154(b) by 0 days.

(21) Appl. No.: 17/551,456

(22) Filed: Dec. 15, 2021

(65) Prior Publication Data

US 2022/0193725 A1 Jun. 23, 2022

Related U.S. Application Data

(60) Provisional application No. 63/127,551, filed on Dec. 18, 2020.

(51) Int. Cl.
*B07B 1/46* (2006.01)

(52) U.S. Cl.
CPC ..... *B07B 1/4609* (2013.01); *B07B 1/4645* (2013.01)

(58) Field of Classification Search
CPC ..... B07B 1/4609; B07B 1/4645
USPC ..... 209/397
See application file for complete search history.

(56) References Cited

U.S. PATENT DOCUMENTS 3,900,393 A 8/1975 Wilson
8,887,921 B2 11/2014 Mohanka
8,925,732 B2 * 1/2015 Mohanka ..... B07B 1/4645 209/397
9,481,404 B1 * 11/2016 Rich ..... B62D 33/033
9,724,732 B2 8/2017 Moon et al.
2012/0024763 A1 2/2012 Gindele et al.
2014/0192459 A1 * 7/2014 Kwong ..... G06F 3/02 361/679.01

FOREIGN PATENT DOCUMENTS

CA 2769466 A1 * 2/2011 ..... B07B 1/4609
CA 2787183 A1 * 7/2011 ..... B07B 1/4609
DE 1233239 1/1967
DE 2532375 2/1977
DE 102017211958 1/2019
GB 729938 5/1955
(Continued)

OTHER PUBLICATIONS

International Search Report and Written Opinion for Application No. PCT/US2021/063775, dated Apr. 4, 2022, 15 pages.

*Primary Examiner* — Terrell H Matthews
(74) *Attorney, Agent, or Firm* — Dority & Manning, P.A.

(57) ABSTRACT

A screen system for screening a mixture of particulate materials includes a support frame configured for receiving a plurality of modular and replaceable screen panels. Each screen panel defines a plurality of apertures that extend along a vertical direction through the screen panel and a plurality of insert recesses that are positioned around the plurality of apertures. One or more ceramic aperture inserts are positioned within the insert recesses such that the screen panel and the ceramic aperture inserts define a screening surface, and wherein each of the plurality of apertures in the screening surface are at least partially defined and surrounded by the ceramic aperture inserts.

20 Claims, 6 Drawing Sheets

(56) References Cited

FOREIGN PATENT DOCUMENTS

| | | | | | |
|---|---|---|---|---|---|
| NZ | 601163 | A * | 6/2014 | ..... | B07B 1/4609 |
| WO | WO-2007105227 | A1 * | 9/2007 | ..... | B07B 1/4654 |
| WO | WO-2011086572 | A1 * | 7/2011 | ..... | B07B 1/4609 |
| WO | WO-2022036390 | A1 * | 2/2022 | | |

* cited by examiner

CERAMIC LINED APERTURE SCREENING PANEL

PRIORITY CLAIM

The present application claims the benefit of priority of U.S. Provisional Application Ser. No. 63/127,551, titled "Ceramic Lined Aperture Screening Panel," filed on Dec. 18, 2020, which is incorporated herein by reference.

FIELD

The present disclosure relates generally to screening systems, or more particularly, screen panels for use in screening systems.

BACKGROUND

Screening systems are used in the mining and other industries to size and separate desired materials from less desired materials, e.g., by screening particulate materials. Certain screening systems are composed of a plurality of modular and replaceable screening media. For example, the screening media can include modular screen panels which are removably mountable to a support frame to define an overall screening surface. The screen panels include a plurality of screening apertures dimensioned to separate the desired material from less desired material.

During a typical screening process, the screening system is vibrated and the mixture of particulate material is deposited on the screening surface. The particulate material migrates in a preferential feed direction on the screening system, and the screening apertures allow smaller material particles to pass through the screening surface while preventing larger material particles from passing through the screening surface, thereby achieving desired sizing separation of the particulate material.

Certain screening panels, however, can suffer several disadvantages. For example, conventional screen panels are constructed of a frame or insert that is encapsulated by a resilient material, such as a polymeric material, such as polyurethane or rubber. However, the intense vibrations and abrasive nature of the screening process results in excessive wear that can abrade or remove material from the relatively soft polymeric materials. This wear results in premature failure of the screen panels and requires frequent monitoring, maintenance, or panel replacement. Moreover, as the screen panel wears away over time, the shape and size of the screening apertures in the screen panel changes, resulting in apertures that are no longer suitable for their original screening intent. In this regard, wear may effectively expand the screening apertures to a size which allows particles that are unacceptably large to pass through the screen panel, thus defeating the purpose of material screening panel and requiring premature repair or replacement.

Accordingly, a screening system including screen panels having improved wear characteristics would be useful. More specifically, screen panels that are capable of screening abrasive materials with reduced wear and long lifetime while maintaining the designed aperture geometries for the extended lifetime of the screen panel would be particularly beneficial.

SUMMARY

Aspects and advantages of embodiments of the present disclosure will be set forth in part in the following description, or may be learned from the description, or may be learned through practice of the embodiments.

In one example embodiment, a screening system is provided including a screen panel at least partially defining a screening surface and an aperture configured to separate material and a ceramic aperture insert mounted to the screen panel, the ceramic aperture insert at least partially defining the screening surface and the aperture.

In another example embodiment, a screen system is provided including a screen panel defining a plurality of apertures that extend along a vertical direction through the screen panel, each of the plurality of apertures being at least partially defined by an aperture wall of the screen panel, the screen panel further defining at least one insert recess defined above the aperture wall along the vertical direction. One or more ceramic aperture inserts are positioned within the at least one insert recess, each of the plurality of apertures being defined by an inner face of the one or more ceramic aperture inserts and the aperture wall of the screen panel, and wherein a screening surface is defined by a top surface of the screen panel and a top face of the one or more ceramic aperture inserts.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures.

Figure 1:
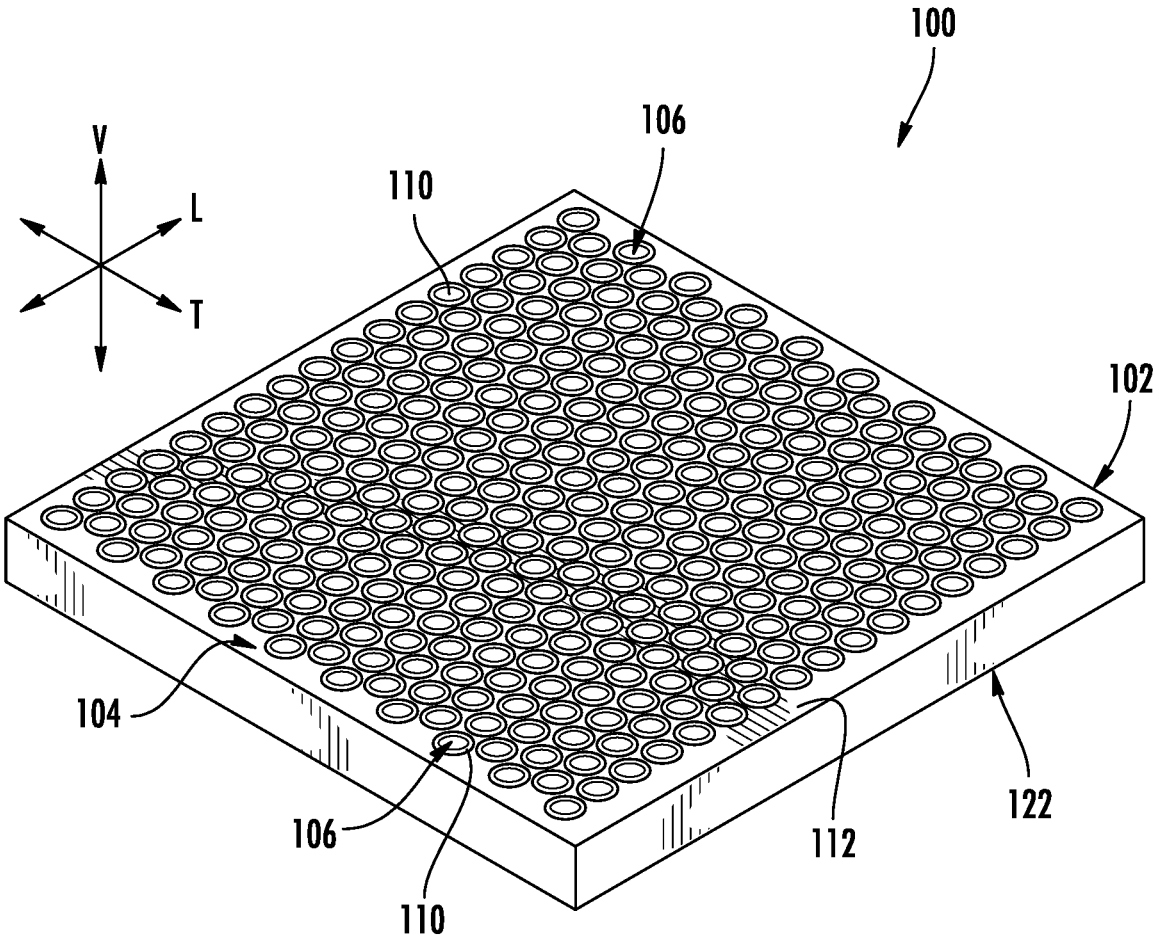
FIG. 1 depicts an example screen panel with ceramic aperture inserts according to example embodiments of the present disclosure.

Repeat use of reference characters in the present specification and drawings is intended to represent the same or analogous features or elements of the present invention.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "example" is used herein to mean "serving as an example, instance, or illustration." In addition, references to "an embodiment" or "one embodiment" does not necessarily refer to the same embodiment, although it may. Any implementation described herein as "example" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now generally to FIGS. 1 through 11, aspects of the present disclosure will be described according to various example embodiments of the present subject matter. For example, aspects of the present disclosure are directed to screening systems 100 which may be used in the mining and other industries to size and separate desired materials from less desired materials, e.g., by screening aggregate material, particulate materials, or other mixtures having various particulate sizes and shapes. For example, screening system 100 may generally include support frames and additional systems for transporting screening materials, vibrating screening system 100, and performing other actions to facilitate the screening process. For brevity, detailed discussion of these components is omitted from the present discussion.

As explained above, certain screening systems are composed of a plurality of modular and replaceable screening media. For example, aspects of the present subject matter are generally directed to screen panels 102 for used in screening systems, such as screening system 100, for screening materials. These screen panels 102 may be modular and may be removably mounted to the support frame of screening system 100 to define an overall screening surface (e.g., identified generally herein by reference numeral 104). Each screen panel 102 may generally include or define a plurality of screening apertures 106 that are dimensioned for a particular application in order to separate desired materials from less desired materials.

During a typical screening process, screening system 100 vibrates one or more of screen panels 102 while a mixture of particulate material is deposited on screening surface 104. The mixture of particulate material may migrate in a preferential feed direction on the screening surface 104, and screening apertures 106 may allow smaller material particles to pass through screening surface 104 while preventing larger material particles from passing through screening surface 104, thereby achieving desired sizing separation of the mixture of particulate material.

Increased wear life of screening media (e.g., such as screen panel 102) used to sort particle size in mining, aggregate, and other material processing applications is always desirable. The abrasive nature of the screening process encourages use of screen media made from materials that are highly resistant to abrasion wear. Over time, as the media wears away, the shape and size of the apertures in the media material changes resulting in undesirable variation in the size of particles passing through the screen media. Practical applications require a balance among the cost of the screen media, the wear rate of the screen media, and a tolerable amount of particle size variation for material passing through the screen media.

Accordingly, to address the various issues set forth above, aspects of the present subject matter are generally directed to screen panels 102 with improved abrasion and wear resistance. More specifically, screen panels 102 described herein are particularly suited to reduce wear from interaction with mixtures of aggregate screening materials, generally resulting in a longer panel lifetime and better screening performance. In addition, each of the screen panels 102 described herein includes features for reducing wear, particularly around the apertures 106 that are used to screen the material mixtures. Notably, improved abrasion and wear resistance around the apertures may result in improved screening for the lifetime of screen panels 102, as the shape and size of the apertures 106 remain relatively constant.

Example screen media materials can include steel wire, stainless steel wire, rubber, and urethane elastomers. One class of materials noteworthy for their abrasion resistance are engineered ceramics. Driven by their inherent hardness, ceramics offer unparalleled resistance to abrasive wear and may be used in mining and aggregate material handling applications where severe abrasion occurs. Example aspects of the present disclosure can utilize the abrasive wear resistance of engineered ceramics to create screen media with higher degrees of open area, longer wear life, and more consistent particle size outputs. Accordingly, screen panels 102 can include, for instance, one or more ceramic aperture inserts (e.g., identified generally by reference numeral 110) that extend at least partially around a perimeter of at least one aperture 106 for improve wear resistance and panel durability. Various screen panels 102 and configurations of ceramic aperture inserts 110 will be described herein according to example embodiments of the present subject matter. Due to similarity between embodiments, like reference numerals may be used to refer to the same or similar features among embodiments.

Specifically, referring now briefly to FIGS. 1 through 3, an example screen panel 102 and ceramic aperture inserts 110 will be described according to example embodiments of the present subject matter. As illustrated, screen panel 102 may generally be a solid or substantially solid panel with a plurality of apertures 106 that are molded, punched, or otherwise formed within screen panel 102. In general, screening system 100 may rely at least in part on the force of gravity during the screening process and each screen panel 102 may generally define a vertical direction V, a lateral direction L, and a transverse direction T, each of which is mutually perpendicular, such that an orthogonal coordinate system is generally defined. According to an example embodiment, the vertical direction V of screen panel 102 is substantially aligned or parallel to the force of gravity.

According to an example aspect of the present disclosure, screen panel 102 may include a polymer matrix 112 or other suitable support frame for maintaining the integrity of apertures 106 even through the intense screening process. In some embodiments, a reinforcing structure can be embedded within the polymer matrix 112 or attached to the polymer matrix 112 to provide strength and stiffness to the composite screening panel 102. The polymer can be of any type such as a rubber or urethane elastomer or blends of elastomers or other suitable polymers. For example, the reinforcing structure can be made of steel, aluminum, fiber reinforced polymer, or other suitable reinforcing materials and can be shaped such that is does not interfere with the positioning of ceramic aperture inserts 106.

The polymer matrix 112 surrounding the ceramic aperture inserts 110 can serve to bind together the ceramic aperture inserts 110 in predetermined patterns for optimal screening performance. For example, the polymer matrix 112 can fill the spaces between and around the ceramic aperture inserts 110. In this regard, the polymer matrix 112 serves to separate and isolate the ceramic aperture inserts 110 and to bond the ceramic aperture inserts 110 together forming a modular screen panel 102 with defined dimensions and a well-defined aperture pattern. The polymer material can also serve to provide additional features such as attachment elements to attach screen panel 102 to a frame system. For example, in some embodiments, screen panel 102 can include features for attaching to a support system, such as one or more mounting bosses 114 (see, e.g., FIG. 4).

In some embodiments, screen panel 102 may further include a structural reinforcing frame (not shown) or a frame for locating ceramic aperture inserts 106. In some embodiments, a ceramic aperture insert positioning frame can be used to create and maintain a certain spacing and pattern of the ceramic aperture inserts 110. The positioning frame can be made of steel, aluminum, or more preferably polymer, or most preferably fiber reinforced polymer composite. The positioning frame can contain features such as tabs or grooves that engage with the ceramic aperture inserts 110. The ceramic aperture insert positioning frame may be at least partially embedded within the polymer matrix 112.

As illustrated, according to example embodiments, ceramic aperture inserts 110 can be incorporated into screen panel 102 and may extend around the entire perimeter of the apertures 106. Therefore, the aperture size and shapes maybe defined by the characteristics of the openings in the ceramic aperture inserts 110. The composite screen panel 102 can have defined dimensions and one or more ceramic aperture inserts 110 can be arranged in a defined pattern configured for improved overall screening process performance. For example, as illustrated in FIG. 1, apertures 106 are substantially circular and are each fitted with circular ceramic aperture inserts 110.

As illustrated, ceramic aperture inserts 110 only extend through a portion of the height of screen panel 102. For example, ceramic aperture inserts 110 may define a height that is less than ½, less than ¼, less than ⅛, or less, than a height of screen panel 102 as measured along the vertical direction V. By contrast, according to alternative embodiments ceramic aperture inserts 110 may extend to the entire thickness or height of screen panel 102. According to exemplary embodiments, the height of ceramic aperture inserts 110 may be defined relative to the average aperture dimension, e.g., such as the width measured along the lateral direction L. For example, the height of ceramic aperture inserts 110 may be less than ½ of the aperture width, less than ¼ of the aperture width, less than ⅛ of the aperture width, or less. It should be appreciated that the ratio of the insert height to the aperture size (e.g., width) and the ratio of the insert height to the height of screen panel 102 may vary while remaining within the scope of the present subject matter, e.g., based at least in part on the tendency or lack of tendency for the rocks or particles to get stuck or "peg" or "plug" the apertures 106.

In some embodiments, the ceramic aperture inserts 110 can be made of ceramic material such as alumina, aluminum oxide, zirconia, silicon carbide, tungsten carbide, diamond, or blends of such materials chosen for their wear resistance. The ceramic aperture insert can define a three-dimensional volume with a shape comprising an upper surface, a lower surface and an outer perimeter surface. At least one hollow opening extends through the volume from the upper surface to the lower surface forming an aperture. Although example shapes, sizes, geometries, and configurations of ceramic aperture inserts 110 are described below to facilitate discussion of aspects of the present subject matter, it should be appreciated that these inserts are not intended to be limiting in any manner. Indeed, variations and modifications to ceramic aperture inserts 110 may be made while remaining within the scope of the present subject matter.

According to the illustrated embodiment, screen panel 102 may generally define a screening surface 104 that is a substantially planar surface configured for receiving the mixture of particulate material. For example, according to the illustrated embodiment, screening surface 104 may be positioned above and opposite a bottom side 122 of screen panel 102 along the vertical direction V. In general, each aperture 106 may be defined by an aperture wall 124 of screen panel 102 and may extend through screen panel 102 substantially along the vertical direction V. Specifically, aperture 106 may extend from an aperture inlet 126 which is substantially coplanar with screening surface 104 and an aperture outlet 128 that is substantially coplanar with a bottom side 122 of screen panel 102. During operation, material that is small enough to fit through aperture 106 may fall under the force of gravity through aperture inlet 126, into aperture 106, and out of aperture 106 through aperture outlet 128.

Figure 6:
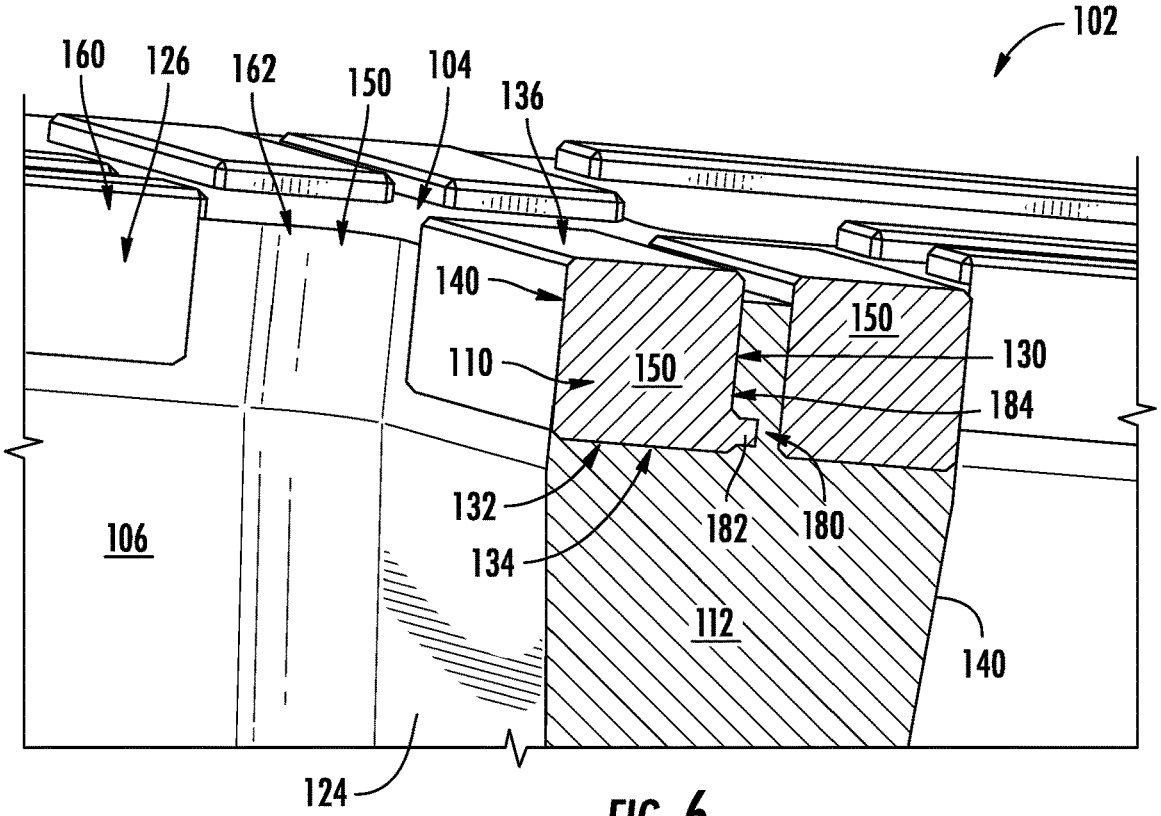
FIG. 6 depicts a close-up, cross-sectional view of the example ceramic aperture inserts and screen panel of FIG. 4 according to example embodiments of the present disclosure.

In general, ceramic aperture inserts 110 may be embedded within, seated into, or mounted to screen panel 102 (e.g., or more particularly within the polymer matrix 112 of screen panel 102) in any suitable manner. For example, as best illustrated in FIGS. 3 and 6, screen panel 102 may generally define insert recesses 130 that are sized and configured for receiving ceramic aperture inserts 110. More specifically, according to the illustrated embodiment, insert recesses 130 may be defined above aperture walls 124 and may be defined such that screen panel 102 defines a support shoulder 132 that is positioned below screening surface 104 along the vertical direction V, such that a bottom face 134 of ceramic aperture inserts 110 is seated on support shoulder 132. When so positioned, a top face 136 of ceramic aperture insert 110 may be flush with screening surface 104 (e.g., may be coplanar with screening surface 104). By contrast, according to the illustrated embodiment, top face 136 of ceramic aperture inserts 110 may extend slightly above screening surface 104 along the vertical direction V. According to example embodiments, top face 136 of ceramic aperture insert 110 may at least partially define screening surface 104 of screen panel 102.

According to example embodiments ceramic aperture inserts 110 may further define an inner face 140 that at least partially defines aperture 106. In this regard, inner face 140 may be directly adjacent and form at least a partial boundary of aperture 106. According to an example embodiment, inner face 140 of ceramic aperture inserts 110 may sit substantially flush with aperture wall 124 of screen panel 102. Moreover, referring now briefly to FIGS. 3 and 5, inner face 140 and/or aperture wall 124 may be tapered to define a relief angle 142 relative to the vertical direction V. In this manner, for example, aperture inlet 126 may generally have a smaller cross-sectional area than aperture outlet 128, e.g., such that relief angle 142 may facilitate the easy exit of particles passing through screen panel 102. According to example embodiments, relief angle 142 may be between about 0.5° and 20°, between about 1° and 10°, between about 3° and 5°, or about 4° relative to the vertical direction V. Although aperture 106 is illustrated as being tapered at a fixed angle, it should be appreciated that according to alternative embodiments, aperture 106 may be stepped or have any other suitable cross-sectional geometry or profile while remaining within the scope of the present subject matter.

Notably, when ceramic aperture inserts 110 are positioned within insert recesses 130 of screen panel 102, the polymer matrix 112 of screen panel 102 and the ceramic aperture inserts 110 generally define an upper screening surface 104 and extend substantially within a horizontal plane (e.g., defined by the lateral direction L and the transverse direction T). In addition, the polymer matrix 112 and ceramic aperture inserts 110 collectively define each aperture 106 and the ceramic aperture inserts 110 may be particularly suited to prevent wear or abrasion on the edges surrounding aperture inlet 126, such that the size, shape, and geometry of apertures 106 may remain relatively constant over the lifetime of screen panel 102.

Figure 2:
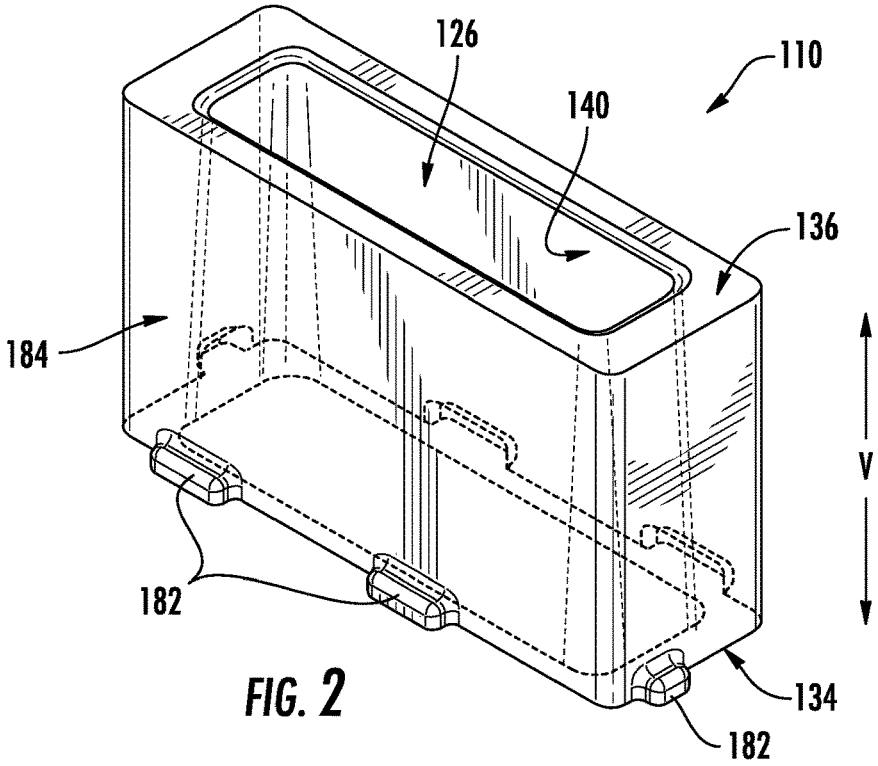
FIG. 2 depicts a perspective view of a ceramic aperture insert according to example embodiments of the present disclosure.
Figure 3:
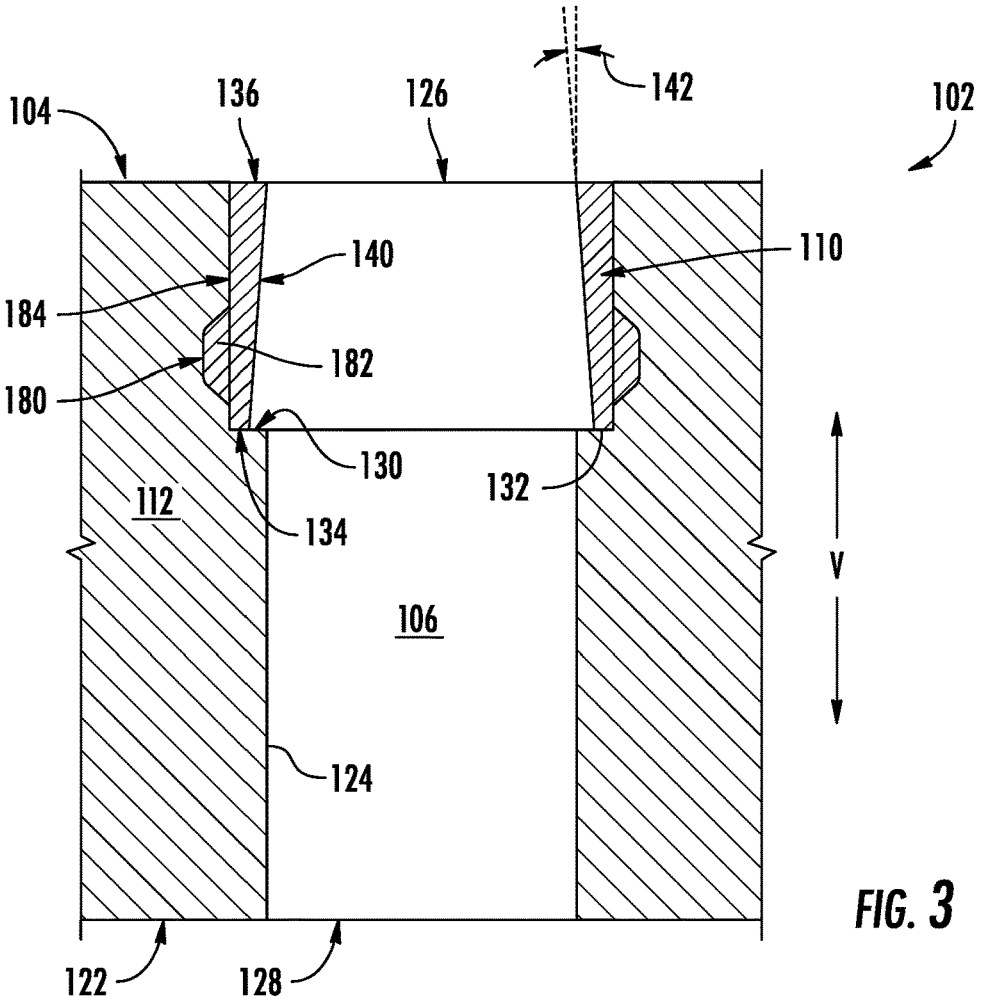
FIG. 3 depicts a cross-sectional view of a ceramic aperture insert mounted within an aperture of a screen panel according to example embodiments of the present disclosure.
Figure 4:
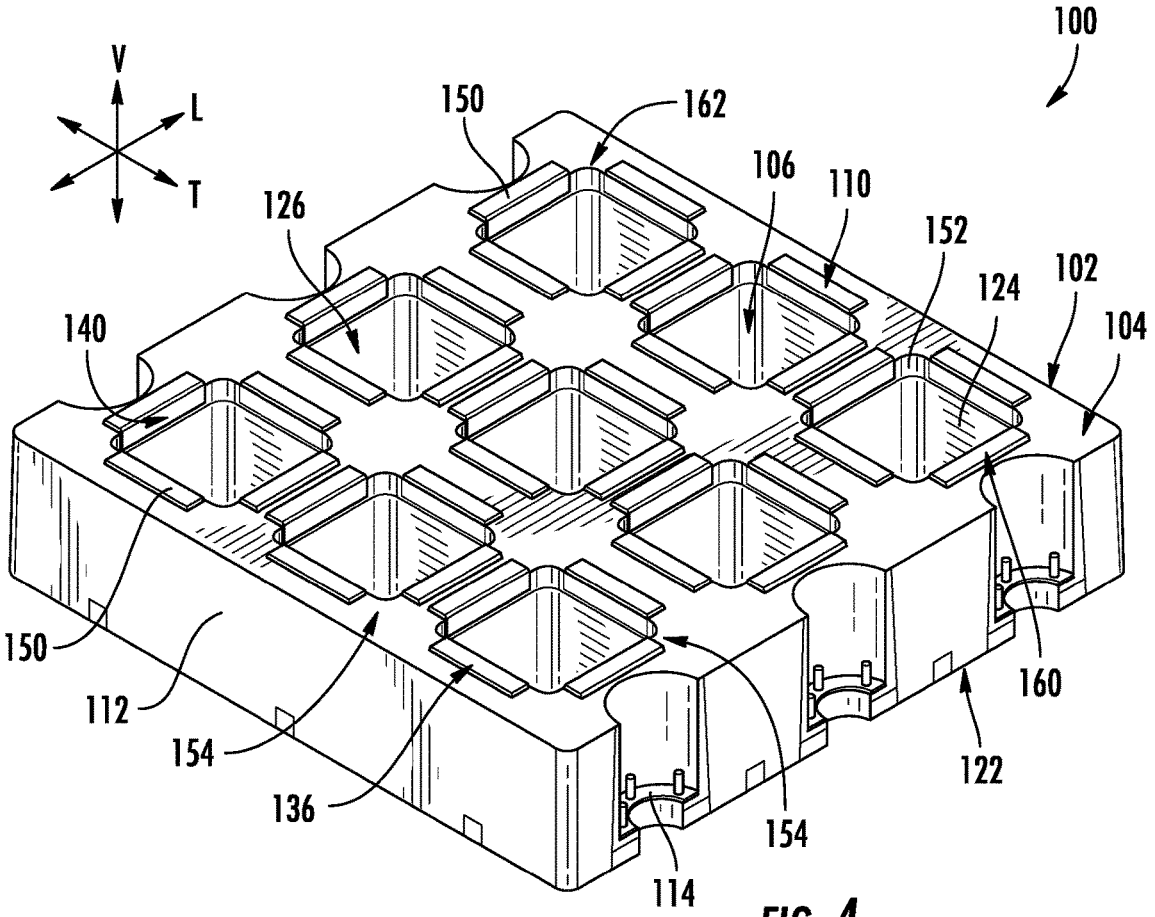
FIG. 4 depicts a perspective view of a screen panel with ceramic aperture inserts according to another example embodiment of the present subject matter.
Figure 5:
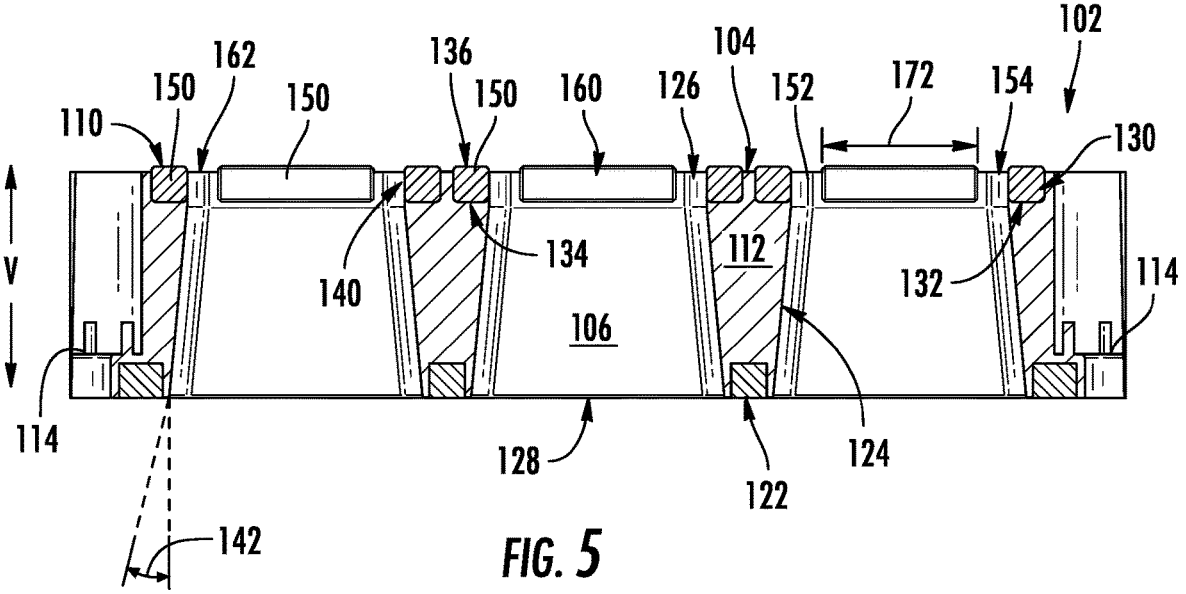
FIG. 5 depicts a side, cross-sectional view of the example screen panel of FIG. 4 according to example embodiments of the present disclosure.

According to the embodiment illustrated in FIGS. 1 through 3, ceramic aperture inserts 110 are formed from a single piece and are circular or rectangular in cross-sectional profile. In this regard, ceramic aperture inserts 110 may extend around an entire perimeter of aperture 106 to form a full enclosure around the aperture 106. However, it should be appreciated that the size, shape, and geometry of ceramic aperture inserts 110 may change while remaining within the scope of the present subject matter. For example, ceramic aperture insert shapes can include hollow cylinders, rings, eyelets, squares, rectangles, or modifications thereof. Moreover, referring now generally to FIGS. 4 through 11, each ceramic aperture insert 110 may be formed from a plurality of insert segments (identified herein generally by reference numeral 150) that collectively form the ceramic aperture insert 110.

Figure 9:
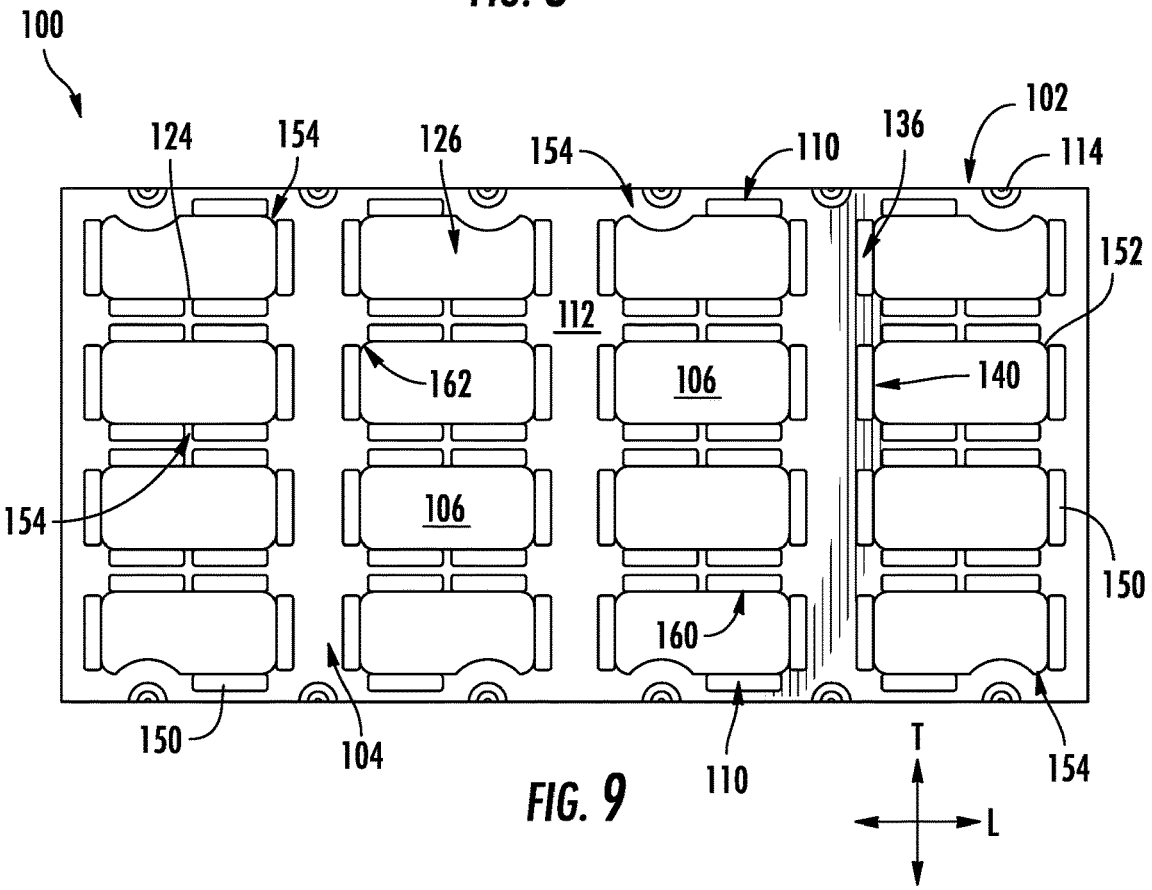
FIG. 9 depicts a top view of an example screen panel with ceramic aperture inserts according to example embodiments of the present disclosure.
Figure 11:
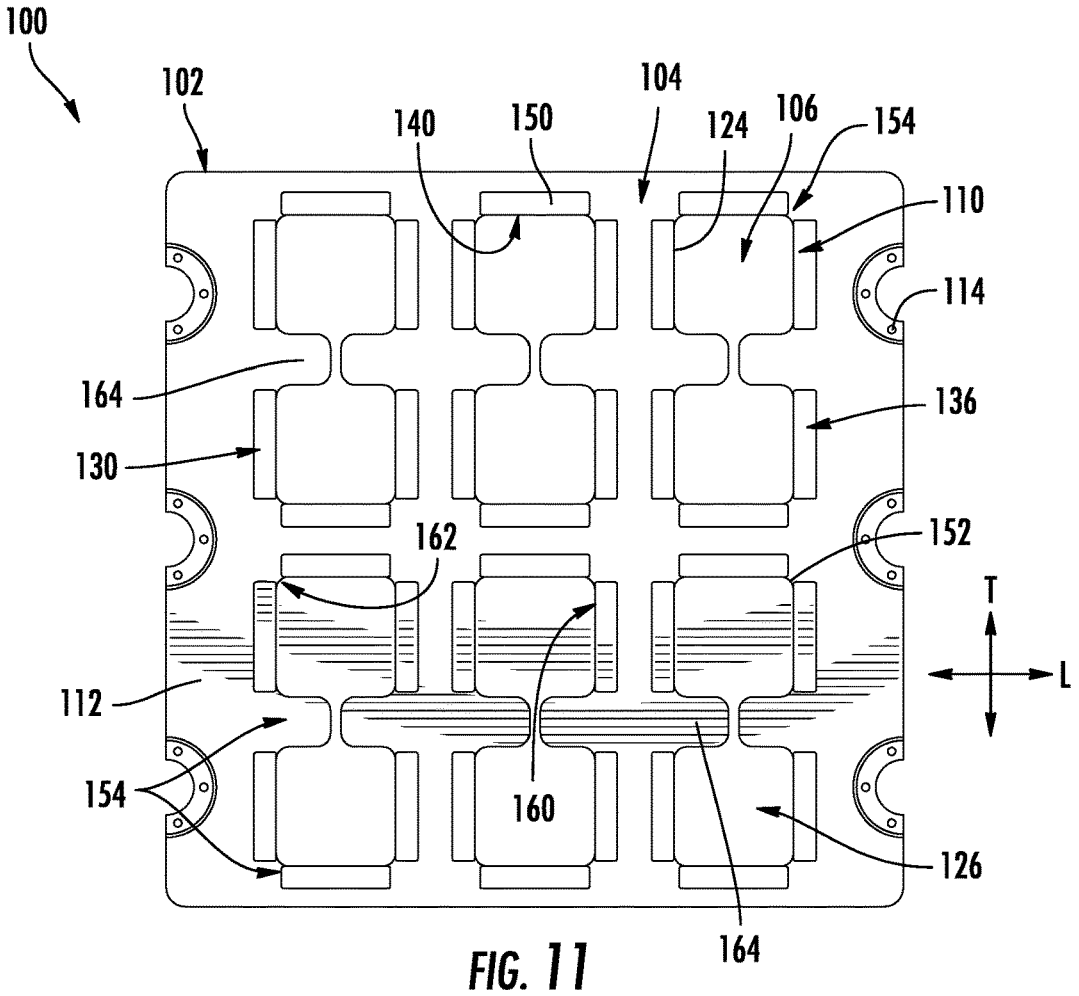
FIG. 11 depicts a top view of an example screen panel with ceramic aperture inserts according to example embodiments of the present disclosure.

For example, the plurality of insert segments 150 may generally be positioned around the perimeter 152 of each aperture 106 such that at least one perimeter gap 154 is defined between adjacent segments 150. In this regard, as shown for example in FIG. 5, the ceramic aperture insert 110 can include four separate insert segments 150 (e.g., a first segment, a second segment, a third segment, and a fourth segment) that fit together to line the perimeter 152 of the aperture 106. In alternative embodiments, the ceramic aperture insert 110 can be divided into more or fewer segments 150. For instance, as shown in FIGS. 9 and 11, the ceramic aperture insert 110 can be divided into six separate segments 150 that fit together to line the perimeter of the aperture 106. In some implementations, as shown in the figures, the different segments 150 of the ceramic aperture insert 110 can be spaced apart from one another by perimeter gaps 154 that are defined between adjacent segments 150. However, according to alternative embodiments, perimeter gaps 154 may be eliminated and adjacent segments 150 may contact or butt directly up to each other.

Figure 10:
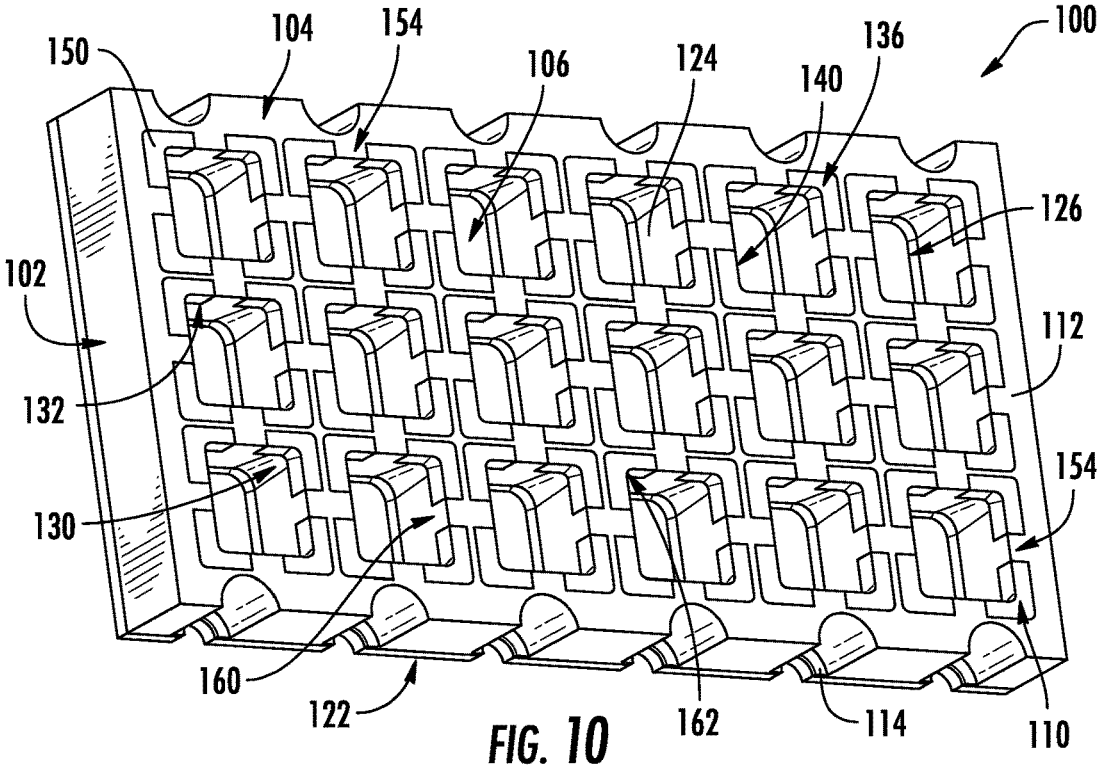
FIG. 10 depicts a perspective view of an example screen panel with ceramic aperture inserts according to example embodiments of the present disclosure.

The exact configuration of insert segments 150 may vary in order to achieve various performance objectives of a particular screen panel 102. Aspects of the present subject matter are not restricted to any particular configuration of insert segments 150 illustrated herein. According to an example embodiment, as best illustrated in FIGS. 4, 8, 9, and 11, insert segments 150 may be positioned along one or more edges of the aperture profile. More specifically, aperture 106 may have a rectangular profile (e.g., as defined within a horizontal plane or a plane that is coplanar to screening surface 104). According to the illustrated embodiment, insert segments 150 may be positioned along the edges 160 of these rectangular profiles. In addition, perimeter gaps 154 may generally be defined in the corners 162 of the rectangular profile of apertures 106. According to still other embodiments, perimeter gaps 134 may also be defined between multiple insert segments 150 that are positioned along a single edge 160. By contrast, as best illustrated in FIG. 10, insert segments 150 may be curved or angled at approximately 90° and positioned within corners 162 of apertures 106. In this manner, perimeter gaps 154 may be defined along edges 160 of aperture 106, e.g., between the ends of insert segments 150.

Referring now briefly to FIG. 11, screen panel 102 may further define one or more panel extensions 164 that generally protrude into apertures 106. In this regard, panel extensions 164 may be the portion of the polymer matrix 112 of screen panel 102 that extend into apertures 106 and that serve to form the perimeter gap 154 between adjacent insert segments 150. In addition, panel extensions 164 may generally prevent large particulates from passing through aperture 106 while permitting some flexibility for moderate size particulates. Furthermore, as shown in FIGS. 4 through 11, perimeter gap 154 may generally be filled with a polymeric material, e.g., a portion of screen panel 102. In this manner, screen panel 102 may fill at least one of the perimeter gaps 154 such that inner face 140 of insert segments 156 substantially flush with aperture wall 124 of screen panel 102.

In general, it may be desirable to ensure that perimeter 152 of aperture 106 is largely bounded by insert segments 150. In this regard, it may be desirable to carefully control the ratio of perimeter gaps 154 to insert segments 150. For example, according to example embodiments, insert segments 150 may form greater than 60%, greater than 70%, greater than 80%, greater than 90%, or greater than 95% of the total linear perimeter 152 of aperture 106. In addition, it may be desirable to regulate the average gap length relative to the length of insert segments 150. In this regard, an average gap length 170 may be defined as the linear distance of the perimeter gaps 154 as measured along the perimeter 152 of aperture 106. In addition, an average insert length 172 may be measured as the average length of insert segments 150 as measured along the perimeter 152 of aperture 106. In general, the average gap length 170 may be less than ½ of the average insert length 172, less than ¼ of the average insert length 172, less than ⅛ of the average insert length 172, less than 1/16 of the average insert length 172, or less.

According to example embodiments, screen panel 102 may use various mechanisms and features to ensure ceramic aperture inserts 110 are securely and firmly embedded within screen panel 102. For example, in some embodiments, the surfaces of ceramic aperture inserts may be treated with a bonding agent to facilitate adhesion to the polymer matrix 112 of screen panel 102. Bonding agents can include any suitable material but, in some embodiments, can be silane based. For example, commercial bonding agents for ceramic to rubber bonding may include Chemlok® 6411 with Chemlok® 144 primer or Cilbond® 24. For example, for ceramic to urethane bonding, a bonding agent may include Chemlok® 213 or Cilbond® 48 or Cilbond® 49SF. Other suitable bonding agents are possible and within the scope of the present subject matter.

Figure 7:
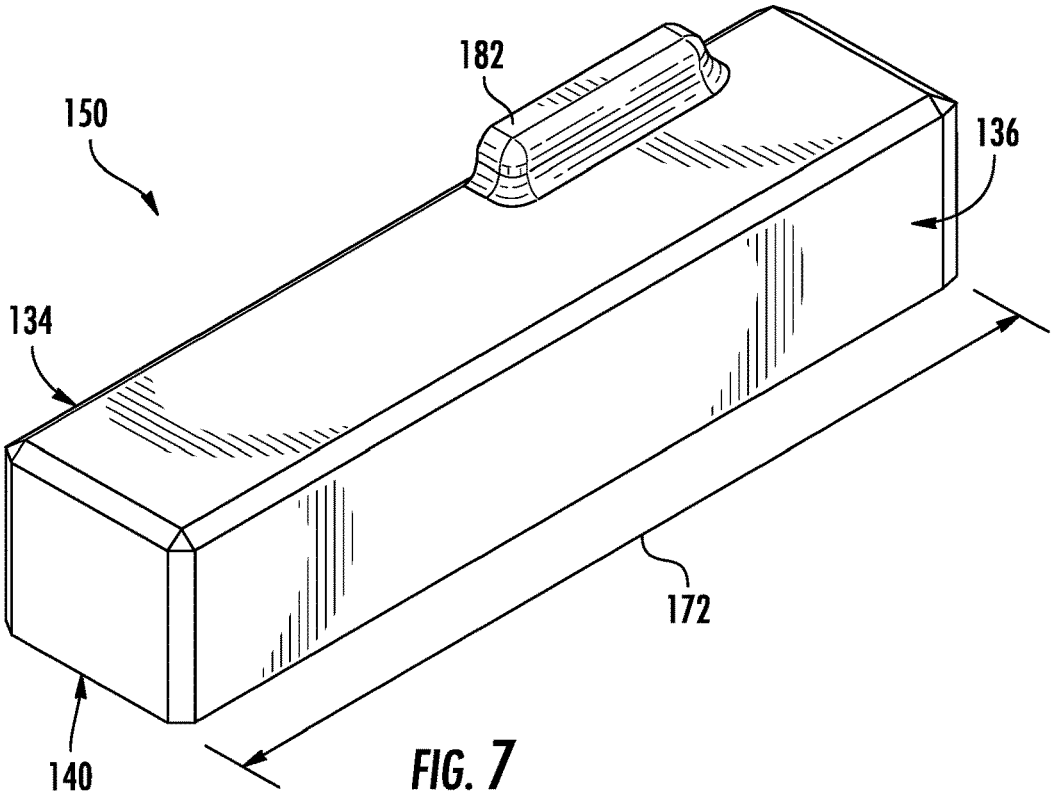
FIG. 7 depicts a perspective view of an insert segment of the example ceramic aperture insert of FIG. 4 according to example embodiments of the present disclosure.
Figure 8:
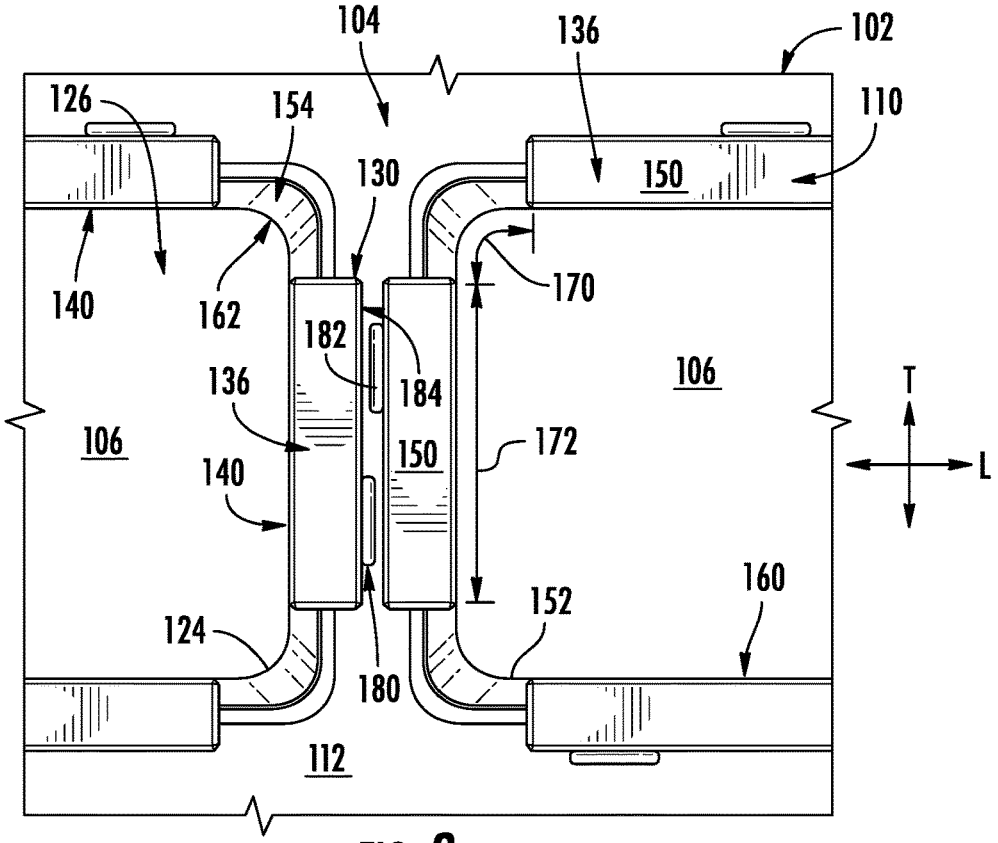
FIG. 8 depicts a top view of the example ceramic aperture inserts and screen panel of FIG. 4 illustrated partially in phantom according to example embodiments of the present disclosure.

According to still other embodiments, screen panel 102 and ceramic aperture inserts 110 may define complementary recesses and/or protrusions that are intended to provide mechanical interlocking of the two components for securing ceramic aperture inserts 110 within the polymer matrix 112 of screen panel 102. For example, as best illustrated in FIGS. 6 through 8, screen panel 102 may generally define one or more locking recesses 180 that are defined around aperture 106 or surrounding insert recesses 130 below screening surface 104 along the vertical direction V. In addition, ceramic aperture inserts 110 may define one or more complementary protruding features 182 that are generally configured for receipt with in the one or more locking recesses 180 to secure ceramic aperture insert 110 within screen panel 102. In this regard, during the molding process of screen panel 102, polymer matrix 112 may flow, form, and cure around complementary protruding features 180 to provide secure mechanical engagement of ceramic aperture inserts 110 within screen panel 102.

Referring now briefly to FIGS. 7 and 8 according to example embodiments, the one or more complementary protruding features 182 may be offset from a center of ceramic aperture insert 110 or insert segment 150. More specifically, as best shown on insert segment 150 illustrated in FIG. 7, complementary protruding feature 182 may extend from an engaging face 184 of insert segment 150 (e.g., opposite inner face 140 within a horizontal plane). Complementary protruding feature 182 may be offset along the elongated dimension of engaging face 184. In this manner, as best shown in FIG. 8, insert segments may be positioned immediately adjacent each other on adjacent apertures 106 while minimizing the space there between, e.g., resulting in a smaller bridge between apertures 106 and better screening performance. Although the example illustrated embodiment shows insert segments 150 as defining protruding features 182 and screen panel 102 as defining locking recesses, it should be appreciated that these two features could be swapped or alternated while remaining within the scope of the present subject matter. Moreover, the number, size, geometry, and positioning of such engaging features may vary without departing from the scope of the present subject matter.

In some embodiments, the ceramic aperture insert 110 shape can include additional features. For instance, the ceramic aperture insert 110 can include one or more bumps, tabs, rings, or lips that extend outward from the outer perimeter surface to enable predetermined spacing between adjacent ceramic inserts. In some embodiments, the ceramic aperture insert 110 can include one or more bumps, tabs, rings, lips, indentations, or grooves extending from the outer perimeter surface to enable mechanical interlocking with a ceramic aperture insert positioning frame. In some embodiments, the ceramic aperture insert can include one or more bumps, tabs, rings, lips, indentations, or grooves extending from the outer perimeter surface to enable mechanical interlocking with the polymer matrix 112 of screen panel 102.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A screening system comprising:

a screen panel at least partially defining a screening surface and an aperture configured to separate material; and a ceramic aperture insert mounted to the screen panel, the ceramic aperture insert at least partially defining the screening surface and the aperture, wherein the ceramic aperture insert comprises a plurality of insert segments positioned around a perimeter of the aperture, wherein at least one perimeter gap is defined between adjacent segments of the plurality of insert segments.

2. The screening system of claim 1, wherein the aperture has a rectangular profile and the plurality of insert segments are positioned along one or more edges of the rectangular profile.

3. The screening system of claim 1, wherein the aperture has a rectangular profile and the plurality of insert segments comprises four insert segments positioned in corners of the rectangular profile.

4. The screening system of claim 1, wherein the screen panel fills the at least one perimeter gap such that an inner face of the plurality of insert segments sits flush with an aperture wall of the screen panel defining the aperture.

5. The screening system of claim 1, wherein an average gap length of the at least one perimeter gap is measured along the perimeter of the aperture and an average insert length of the plurality of insert segments is measured along the perimeter of the aperture, and wherein the average gap length is less than half of the average insert length.

6. The screening system of claim 1, wherein the screen panel further defines one or more locking recesses around the aperture and below the screening surface along a vertical direction, and wherein the ceramic aperture insert defines one or more complementary protruding features configured for receipt within the one or more locking recesses to secure the ceramic aperture insert within the screen panel.

7. The screening system of claim 6, wherein the one or more complementary protruding features are offset from a center of the ceramic aperture insert.

8. The screening system of claim 1, wherein the ceramic aperture insert is tapered to define a relief angle measured relative to a vertical direction, wherein the relief angle is between 1 degree and 10 degrees.

9. The screening system of claim 1, wherein the screen panel further defines a support shoulder below the screening surface along a vertical direction, and wherein a bottom face of the ceramic aperture insert is seated on the support shoulder and a top face of the ceramic aperture insert is flush with the screening surface or extends above the screening surface along the vertical direction.

10. The screening system of claim 1, further comprising:

a bonding agent positioned between the ceramic aperture insert and the screen panel.

11. A screen system comprising:

a screen panel defining a plurality of apertures that extend along a vertical direction through the screen panel, each of the plurality of apertures being at least partially defined by an aperture wall of the screen panel, the screen panel further defining at least one insert recess defined above the aperture wall along the vertical direction, wherein the screen panel further defines one or more locking recesses around the at least one insert recess; and one or more ceramic aperture inserts positioned within the at least one insert recess, each of the plurality of apertures being defined by an inner face of the one or more ceramic aperture inserts and the aperture wall of the screen panel, and wherein a screening surface is defined by a top surface of the screen panel and a top face of the one or more ceramic aperture inserts, and wherein the one or more ceramic aperture inserts define one or more complementary protruding features configured for receipt within the one or more locking recesses to secure the one or more ceramic aperture inserts within the screen panel.

12. The screening system of claim 11, wherein the aperture wall of the screen panel sits flush with the inner face of the one or more ceramic aperture inserts.

13. The screening system of claim 11, wherein a top face of the one or more ceramic aperture inserts is flush with the top surface of the screening panel or extends above the top surface along the vertical direction.

14. The screening system of claim 11, wherein the aperture wall of the screen panel and the inner face of the one or more ceramic aperture inserts are tapered to define a relief angle measured relative to the vertical direction, wherein the relief angle is between 1 degree and 10 degrees.

15. The screening system of claim 11, wherein each of the one or more ceramic aperture inserts comprises:

a plurality of insert segments positioned around a perimeter of each of the plurality of apertures, wherein at least one perimeter gap is defined between adjacent segments of the plurality of insert segments.

16. The screening system of claim 11, wherein the screen panel is formed from a fiber reinforced polymer composite.

17. A screening system comprising:

a screen panel at least partially defining a screening surface and an aperture configured to separate material, wherein the screen panel further defines a support shoulder below the screening surface along a vertical direction; and a ceramic aperture insert mounted to the screen panel, the ceramic aperture insert at least partially defining the screening surface and the aperture, wherein a bottom face of the ceramic aperture insert is seated on the support shoulder and a top face of the ceramic aperture insert is flush with the screening surface or extends above the screening surface along the vertical direction.

18. The screening system of claim 17, wherein the ceramic aperture insert comprises a plurality of insert segments positioned around a perimeter of the aperture, wherein at least one perimeter gap is defined between adjacent segments of the plurality of insert segments.

19. The screening system of claim 11, wherein the ceramic aperture insert extends entirely around a perimeter of the aperture to form a full enclosure around the aperture.

20. The screening system of claim 17, wherein the ceramic aperture insert extends entirely around a perimeter of the aperture to form a full enclosure around the aperture.

* * * * *